US008889608B2

(12) United States Patent
Kuratomi et al.

(10) Patent No.: US 8,889,608 B2
(45) Date of Patent: Nov. 18, 2014

(54) LUBRICATING OIL COMPOSITION

(75) Inventors: Tadashi Kuratomi, Kitakyushu (JP); Katsumi Nagano, Tokyo (JP)

(73) Assignee: Nippon Steel & Sumikin Chemical Co., Ltd., Tokyo (JP)

( * ) Notice: Subject to any disclaimer, the term of this patent is extended or adjusted under 35 U.S.C. 154(b) by 82 days.

(21) Appl. No.: 13/634,077

(22) PCT Filed: Mar. 31, 2011

(86) PCT No.: PCT/JP2011/058177

§ 371 (c)(1), (2), (4) Date: Sep. 11, 2012

(87) PCT Pub. No.: WO2011/125819

PCT Pub. Date: Oct. 13, 2011

(65) Prior Publication Data

US 2013/0005631 A1 Jan. 3, 2013

(30) Foreign Application Priority Data

Mar. 31, 2010 (JP) ..... 2010-081324

(51) Int. Cl.

| | |
|---|---|
| ***C07C 55/02*** | (2006.01) |
| ***C10M 105/38*** | (2006.01) |
| ***C07C 69/34*** | (2006.01) |
| ***C07C 67/02*** | (2006.01) |

(52) U.S. Cl.

CPC ..... *C10M 105/38* (2013.01); *C10M 2205/0285* (2013.01); *C10N 2240/04* (2013.01); *C10M 2215/086* (2013.01); *C10M 2215/223* (2013.01); *C10N 2240/204* (2013.01); *C10N 2240/02* (2013.01); *C10M 2215/08* (2013.01); *C10M 2207/2835* (2013.01); *C10N 2230/02* (2013.01); *C10M 2230/02* (2013.01); *C10M 2215/28* (2013.01); *C10M 2215/064* (2013.01); *C10N 2240/08* (2013.01); *C10N 2230/74* (2013.01); *C10N 2220/028* (2013.01)

USPC ..... 508/506; 508/485; 560/190; 560/263

(58) Field of Classification Search

USPC ..... 508/506, 485; 560/190, 263

See application file for complete search history.

(56) References Cited

U.S. PATENT DOCUMENTS

| | | | | |
|---|---|---|---|---|
| 2006/0019840 | A1 * | 1/2006 | Kawahara et al. | 508/280 |
| 2009/0318316 | A1 | 12/2009 | Morishima | |
| 2010/0038582 | A1 * | 2/2010 | Shimomura et al. | 252/67 |

FOREIGN PATENT DOCUMENTS

| | | | |
|---|---|---|---|
| JP | 2000-336383 | A | 12/2000 |
| JP | 2005-154726 | | 6/2005 |
| JP | 2007-39496 | A | 2/2007 |
| JP | 2008-69234 | A | 3/2008 |
| WO | WO-2007/116725 | A1 | 10/2007 |

OTHER PUBLICATIONS

International Preliminary Report on Patentability for Application No. PCT/JP2011/058177 mailed Nov. 22, 2012.

International Search Report for the Application No. PCT/JP2011/058177 mailed Jun. 14, 2011.

* cited by examiner

*Primary Examiner* — Vishal Vasisth

(74) *Attorney, Agent, or Firm* — Cheng Law Group, PLLC

(57) ABSTRACT

Provided are a lubricating oil base oil having characteristics of low volatility and excellent low-temperature fluidity and capable of providing long-lasting lubrication property in a wide temperature range from low temperature to high temperature, and a lubricating oil composition using the same. The lubricating oil base oil includes a diester obtained through a reaction between a diol component formed of 1,12-dodecanediol and a carboxylic acid component formed of 2-methylpentanoic acid or 2-methylpentanoic acid and 2-ethylhexanoic acid. The diester is represented by $R_2COOR_1OOCR_3$, where $R_1$ represents an alkylene derived from the diol component and $R_2$ and $R_3$ each represent an alkyl derived from the carboxylic acid component, and includes 45 to 100 mol % of a diester in which both of $R_2$ and $R_3$ represent C5 alkyls.

8 Claims, No Drawings

LUBRICATING OIL COMPOSITION

This application is a 371 of PCT/JP2011/058177, filed Mar. 31st, 2011.

TECHNICAL FIELD

The present invention relates to a lubricating oil base oil having characteristics of low volatility and excellent low-temperature fluidity and capable of providing long-lasting lubrication property in a wide temperature range from low temperature to high temperature, and a lubricating oil composition using the same.

BACKGROUND ART

A lubricating oil base oil is required to exert its performance stably for a long period of time, i.e., to have low volatility, excellent heat and oxidation stability and low-temperature startability (low-temperature fluidity), and a high viscosity index (wide range). In particular, it is not too much to say that a lubricating oil base oil having characteristics of low viscosity and low volatility is an ultimate aim.

Along with improvements in performance of audio-visual and office automation equipment, a small spindle motor used in a rotating part in the equipment has been strongly required to be refined so as to achieve speed-up and electrical power saving. Therefore, a bearing used in a rotation-supporting part has been constantly required to achieve low torque. Meanwhile, particularly recently, the bearing has been required to have performance applicable to various environments (temperatures) in consideration of use as a mobile device. As a factor having an effect on the torque of the bearing, there are given a bearing clearance and a shaft diameter. In particular, the viscosity of a lubricating oil in a low-temperature environment is a major factor.

In general, a lubricating oil having a lower viscosity tends to easily evaporate. When an amount of the lubricating oil decreases due to evaporation, the bearing is judged to come to the end of its life because of an inappropriate oil film pressure and significantly lowered rotation accuracy. Therefore, an evaporation characteristic of the lubricating oil is an important characteristic which affects durability of the bearing. Accordingly, in lubrication of a sliding bearing such as a fluid dynamic pressure bearing, an oil-impregnated porous bearing, or a dynamic pressure-type oil-impregnated porous bearing, it is necessary to select a lubricating oil which has a low viscosity, does not cause an increase in the viscosity even in a low temperature range, and has a relatively excellent evaporation characteristic. In many cases, an ester-based lubricating oil is used.

Like other lubricating oils, an ester oil tends to have a lower evaporation characteristic as the viscosity becomes lower. Therefore, to reduce the torque of the bearing, even when an ester oil having a lower viscosity than that of a conventional one is selected, the evaporation characteristic is impaired, resulting in a reduction in durability of the bearing. In addition, even when the oil has a low viscosity at ordinary temperature, a rapid increase in torque or stopping of devices may occur when the viscosity increases drastically or the fluidity is lost in a low temperature range.

Particularly, in recent years, hard disks are often installed in home electronics and may be used at low temperature in many cases. Therefore, in order to ensure stable driving, a low viscosity in a low temperature range has been strongly required. Many lubricating oil base oils have been proposed to satisfy such properties. However, in the present circumstances, the oils do not satisfy the low viscosity and low volatility which are ultimate aims although the oils satisfy the properties to some extent.

The low viscosity and low volatility contradict each other. For example, when the viscosity is reduced without changing its structure, the molecular weight decreases, naturally resulting in an increase in volatility. As means for solving such defects, an ester-based base oil having a low viscosity and relatively excellent evaporation property is used.

Patent Literature 1 discloses a lubricating oil composition including, as a base oil, a diester obtained from a linear divalent alcohol having 6 to 12 carbon atoms and a branched saturated monovalent fatty acid having 6 to 12 carbon atoms.

However, according to the conventional technology, a lubricating oil having low-viscosity property can be obtained by appropriately selecting an alcohol and a fatty acid. However, in the case of a diester having a viscosity at 40° C. of 10 $mm^2/s$ or less, the evaporation amount becomes larger as its molecular weight becomes lower. Further, the evaporation occurs concurrently owing to a uniform molecular weight, and hence the durability may drastically deteriorate from a certain condition. This is because many of esters have symmetrical chemical structures. That is, the limiting point is clear because of a single composition, and the evaporation may cause sudden stopping of the motor. This is probably because, in a combination of 1,8-octanediol, 1,9-nonanediol, 1,10-decanediol with 2-ethylhexanoic acid and 3,3,5-trimethylpentanoic acid, which is considered by the above-mentioned conventional technology to be particularly suitable, the viscosity index is small because a ratio of components having branched carbon structures is large based on the molecular weight, and the viscosity becomes particularly high at low temperature, resulting in an adverse effect on driving property of the motor under a usual environment. In addition, this is probably because, as the ratio of the branched structures in the diesters becomes larger, the evaporativity becomes larger.

Patent Literature 2 discloses a lubricating oil composition which contains: as a major component, an ester synthesized from a monovalent alcohol having 8 carbon atoms and a divalent carboxylic acid having 6 carbon atoms; and, at a concentration of 1 to 5 wt %, a diester which is different from the major component, has a kinetic viscosity at 40° C. of 10 $mm^2/s$ or more, and has a total of 23 to 28 carbon atoms in its molecule, and a fluid bearing unit using the lubricating oil composition.

Patent Literature 3 describes a lubricating oil base oil containing, as a major component, a diester compound or a triester compound synthesized from a divalent or trivalent carboxylic acid having 9 or less carbon atoms and a monovalent glycol ether such as an alkylene glycol monoalkyl ether having 3 to 25 carbon atoms.

However, the lubricating oils or lubricating oil base oils described in the literatures do not fully satisfy the requirements of low viscosity and low volatility.

CITATION LIST

Patent Literature

[PTL 1] JP 2008-69234 A
[PTL 2] JP 2007-39496 A
[PTL 3] WO 2007/116725 A1

SUMMARY OF INVENTION

The present invention has been made in view of the above-mentioned problems, and an object of the present invention is to provide a lubricating oil base oil having characteristics of low volatility and excellent low-temperature fluidity and capable of providing long-lasting lubrication property in a wide temperature range from low temperature to high temperature, and a lubricating oil composition using the same.

The present invention relates to a lubricating oil base oil, including one or more kinds of diesters selected from the group consisting of diesters represented by the following formulae (1), (2), and (3), in which the total number of carbon atoms involved in methyl groups and ethyl groups present as branched structures in the diesters represented by the formulae (1), (2), and (3) is 11% or less with respect to the number of all carbon atoms, and the ratio (molar ratio) of the diesters represented by the formulae (1), (2), and (3) falls within a range of (1):(2):(3)=45 to 100:0 to 45:0 to 12:

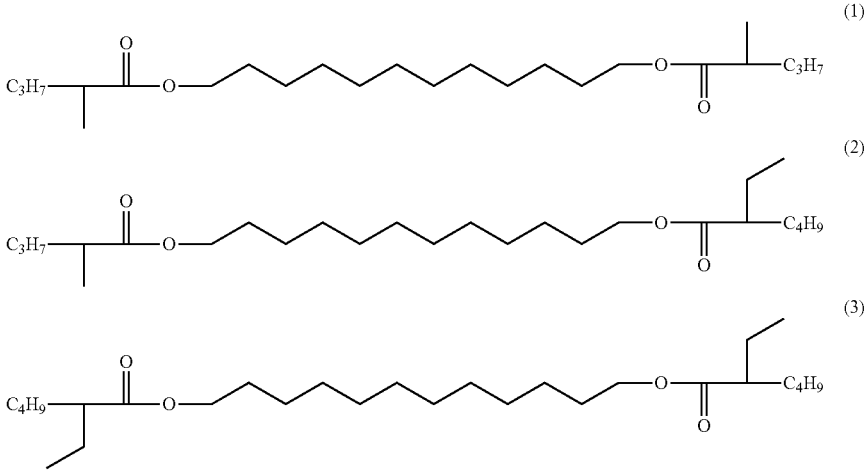

where $C_3H_7$ and $C_4H_9$ represent n-$C_3H_7$ and n-$C_4H_9$, respectively.

In the lubricating oil base oil, it is preferred that the total of the diesters represented by the formulae (1), (2), and (3) be 70 wt % or more with respect to the lubricating oil base oil.

It is preferred that the lubricating oil base oil include, at a concentration of 30 wt % or less, a low-viscosity oil which includes a polyol ester having a kinetic viscosity at 40° C. of less than 9 $mm^2/s$, having a viscosity index of 100 or more, and having a neopentyl glycol skeleton. It is more preferred that the low-viscosity oil include a polyol ester obtained from caprylic acid or capric acid and neopentyl glycol.

The present invention also relates to a lubricating oil composition which is obtained using the lubricating oil base oil.

DESCRIPTION OF EMBODIMENTS

Embodiments of the present invention are described below.

A lubricating oil base oil of the present invention contains one or more kinds of diesters selected from the group consisting of diesters represented by the formulae (1), (2), and (3), and the ratio (molar ratio) of the diesters represented by the formulae (1), (2), and (3) falls within a range of (1):(2):(3)=45 to 100:0 to 45:0 to 12. Further, in the diesters represented by the formulae (1), (2), and (3), the total number of carbon atoms involved in methyl groups and ethyl groups present as branched structures is 11% or less with respect to the number of all carbon atoms. The lubricating oil base oil has no excessive branched chains, and hence has a high viscosity index and a particularly low viscosity in a low temperature range. In addition, the oil is excellent in low evaporativity.

The lubricating oil base oil of the present invention is obtained by an esterification reaction of 1,12-dodecanediol with one kind or two kinds of acids selected from 2-methylpentanoic acid and 2-ethylhexanoic acid. 2-Methylpentanoic acid is essential, but 2-ethylhexanoic acid is optionally used.

When only 2-methylpentanoic acid is used as an acid, a diester represented by the formula (1) is generated. When only 2-ethylhexanoic acid is used, a diester represented by the formula (3) is generated. When both 2-methylpentanoic acid and 2-ethylhexanoic acid are used as acids, a diester including diesters represented by the formulae (1) to (3) is generated as a mixture. In this case, the ratio of the diesters varies depending on the ratio of amounts of 2-methylpentanoic acid and 2-ethylhexanoic acid used. It should be noted that when the diester represented by the formula (1) and the diester represented by the formula (3) were separately produced and mixed, a diester including the diesters represented by the formulae (1) and (3) is obtained as a mixture.

In the lubricating oil base oil of the present invention, when the ratio of the diesters represented by the formulae (1), (2), and (3) is adjusted to a certain range, the viscosity at low temperature, evaporativity, and low-temperature fluidity can be improved. The ratio of the diesters represented by the formulae (1), (2), and (3), represented by (1):(2):(3), falls within a range of 45 to 100:0 to 45:0 to 12, preferably a range of 40 to 85:10 to 45:1 to 15.

However, in the lubricating oil base oil of the present invention, it is necessary to adjust the ratio of the number of branched carbon atoms (hereinafter, referred to as "branched carbon atom ratio") to a certain level or less. Herein, the number of branched carbon atoms is calculated from the total number of carbon atoms in the methyl groups and ethyl groups represented as side chains in the formulae (1), (2), and (3). Herein, the term "side chain" refers to an alkyl group to be substituted for a major chain including a linear carbon chain which links $C_3H_7$ or $C_4H_9$ moieties located at both ends in the formulae (1), (2), and (3). For example, the formula (1) is understood to represent a diester having two methyl groups in side chains and having a total of 24 carbon atoms, and in this case, the branched carbon atom ratio is 2/24. On the other hand, the formula (3) is understood to represent a diester having two ethyl groups in side chains and having a total of 28 carbon atoms, and in this case, the branched carbon atom ratio is 4/28. The formula (2) is understood to represent a diester having one methyl group and one ethyl group in side chains and having a total of 26 carbon atoms, and in this case, the branched carbon atom ratio is 3/28. In the case of a mixture of the diesters, the branched carbon atom ratio is calculated as a weighted average of the values. Therefore, the amount of the diester represented by the formula (3) is limited by this.

In the lubricating oil base oil of the present invention, the content of the diesters is preferably 50 wt % or more with respect to the base oil. When the content is 70 wt % or more, the low viscosity and low evaporativity of the lubricating oil at low temperature can be improved sufficiently. As a method of mixing another base oil component by synthesis, there are given a method involving mixing a diol other than 1,12-dodecanediol and esterifying the components and a method involving mixing an acid other than 2-methylpentanoic acid and 2-ethylhexanoic acid and esterifying the components. As a method of mixing another base oil component by mixing, there is given a method of mixing base oil components with an existing base oil such as an ester or a polyalphaolefin.

In particular, a lubricating oil base oil containing a low-viscosity oil which is a polyol ester having a kinetic viscosity at 40° C. of less than 9 $mm^2/s$, having a viscosity index of 100 or more, and having a neopentyl glycol skeleton has an advantage in that low-temperature fluidity can further be given while maintaining the low viscosity and low evaporativity of the lubricating oil at low temperature. The low-viscosity oil component is preferably an esterification product of neopentyl glycol and capric acid or caprylic acid. Further, in the case where the base oil contains the low-viscosity oil, the content is preferably 30 wt % or less with respect to the base oil.

The diester represented by the formula (1), (2), or (3) is prepared from the above-mentioned acid component and diol component in accordance with a conventional method preferably in an inert gas (such as nitrogen) atmosphere in the presence or absence of an esterification catalyst by stirring with heating or the like to diesterify the components. Specifically, a method of synthesizing a diester by esterification at high temperature while water generated by a condensation reaction is removed may be employed. The reaction may be performed without a catalyst or using a catalyst such as sulfuric acid, para-toluenesulfonic acid, or a tetrakis(alkoxy) titanate. The reaction may be performed further using an anhydrous solvent such as toluene, ethyl benzene, or xylene. In the esterification reaction, the acid component is used in an amount of, for example, 2.0 mol or more, preferably 2.01 to 4.5 mol with respect to 1 mol of the diol component.

The lubricating oil base oil of the present invention is used as a base oil for lubricating oil compositions such as a liquid lubricating oil and grease. The lubricating oil composition of the present invention is prepared by using the base oil blending the base oil with a component for improving the performance of the lubricating oil composition in the base oil. Examples of the component include a known additive or thickener such as an antioxidant, an oiliness improver, a wear inhibitor, an extreme pressure agent, a metal deactivator, an anti-corrosive, a viscosity index improver, a pour point depressant, or an antifoamer. One or more kinds of such additives may be appropriately blended. Such additives are added at a concentration of preferably 0.01 to 10 wt %, more preferably 0.03 to 5 wt % with respect to the lubricating oil base oil.

In the case where the lubricating oil composition of the present invention is a grease, a thickener used in the composition is not particularly limited, and a thickener used in a general grease may appropriately be used. Examples thereof include a metal soap, a complexed soap, urea, an organic bentonite, and silica. In general, the content of the thickener in the grease is suitably 3 to 30 wt %. Further, one kind or two or more kinds of additives generally blended, such as an antioxidant, an extreme pressure agent, an anti-corrosive, a metal corrosion inhibitor, an oiliness improver, a viscosity index improver, a pour point depressant, or an adhesion improver may appropriately be blended in the grease. Such additives are usually added at a concentration of preferably 0.01 to 10 wt %, more preferably 0.03 to 5 wt % with respect to a grease base oil.

The lubricating oil composition including the lubricating oil base oil of the present invention can be used in: industrial lubricants such as a hydraulic oil, a gear oil, a spindle oil, and a bearing oil; and various applications such as a dynamic pressure bearing oil, an oil-impregnated sintered bearing oil, a hinge oil, a sewing machine oil, and a sliding surface oil. The composition as a grease is applicable to various lubricating parts such as bearing parts (ball, roller, and needle), sliding parts, and gear parts. In particular, the composition is advantageously applicable to a fluid bearing unit, a fluid dynamic pressure bearing unit, an oil-impregnated porous bearing unit, and a spindle motor equipped with such units.

Examples of preferred use of the lubricating oil composition of the present invention are shown below.

1) Fluid bearing unit: a bearing unit including a bearing part which supports a rotating shaft by an oil film pressure of a lubricating oil present in a gap between an axis outer periphery and a sleeve inner periphery, in which the lubricating oil composition of the present invention is used as a lubricant. 2) Fluid dynamic pressure bearing unit: a bearing unit including a dynamic pressure generating groove in any of the axis outer periphery and sleeve inner periphery, in which the lubricating oil composition of the present invention is used as a lubricant. 3) Oil-impregnated porous bearing unit: a unit having an oil-impregnated porous bearing impregnated with the lubricating oil composition of the present invention. 4) Oil-impregnated porous bearing: a bearing impregnated with the lubricating oil composition of the present invention. Preferred examples of the oil-impregnated porous bearing include a dynamic pressure-type oil-impregnated porous bearing. 5) Spindle motor: a spindle motor equipped with the above-mentioned bearing units.

EXAMPLES

Hereinafter, the present invention is specifically described by way of examples. However, the present invention is by no means limited to the following examples.

Example 1

80.93 g of 1,12-dodecanediol and 185.81 g of 2-methylpentanoic acid were added to a reaction device including a 500-cc four-necked flask, a heating device, a stirring device, a thermometer, a nitrogen vent tube, a nitrogen line, a Dean-Stark tube, a cooling tube, and a cooling line, and subjected to a reaction using tetrakis (IV) (2-ethyl-1-hexyloxy)titanate as a catalyst in a nitrogen atmosphere at 170° C. for 48 hours with stirring until full esterification was achieved. Most of carboxylic acids which remained in the reaction oil were distilled off at 10 Torr and 170° C., and the catalyst was deactivated. The acids which remained in the esters were neutralized, and unreacted compounds and impurities in the esters were removed by an adsorption treatment, to thereby obtain a diester (d1). The composition of the diester was determined by a molar ratio calculated from an area ratio determined by gas chromatography. The diester represented by the formula (1) was found to occupy 99.3 wt % of the whole.

Example 2

A diester (d2) was obtained by esterification using 80.93 g of 1,12-dodecanediol, 91.97 g of 2-methylpentanoic acid, and 12.69 g of 2-ethylhexanoic acid in the same manner as in Example 1. The diester (d2) was a mixture of the diesters represented by the formulae (1), (2), and (3), and the ratio (molar ratio) of diesters represented by the formulae (1), (2), and (3) was found to be (1):(2):(3)=81.1:17.9:1.0. The diesters were found to occupy 99.0 wt % of the whole.

Example 3

A diester (d3) was obtained using 80.93 g of 1,12-dodecanediol, 89.39 g of 2-methylpentanoic acid, and 27.75 g of 2-ethylhexanoic acid in the same manner as in Example 2. The diester (d3) was found to contain the diesters at a ratio of (1):(2):(3)=63.2:32.6:4.1. The diesters were found to occupy 99.3 wt % of the whole.

Example 4

A diester (d4) was obtained using 80.93 g of 1,12-dodecanediol, 78.06 g of 2-methylpentanoic acid, and 41.54 g of 2-ethylhexanoic acid in the same manner as in Example 2. The diester (d4) was found to contain the diesters at a ratio of (1):(2):(3)=57.8:36.5:5.7. The diesters were found to occupy 99.3 wt % of the whole.

Example 5

A diester (d5) was obtained using 80.93 g of 1,12-dodecanediol, 75.00 g of 2-methylpentanoic acid, and 44.50 g of 2-ethylhexanoic acid in the same manner as in Example 2. The diester (d5) was found to contain the diesters at a ratio of (1):(2):(3)=53.9:39.1:7.0. The diesters were found to occupy 99.3 wt % of the whole.

Example 6

A diester (d6) was obtained using 80.93 g of 1,12-dodecanediol, 71.70 g of 2-methylpentanoic acid, and 50.54 g of 2-ethylhexanoic acid in the same manner as in Example 2. The diester (d6) was found to contain the diesters at a ratio of (1):(2):(3)=45.0:44.1:10.8. The diesters were found to occupy 99.3 wt % of the whole.

Example 7

A diester (d7) was obtained by mixing 90 wt % of the diester (d4) synthesized in Example 4 with 10 wt % of a diester of neopentyl glycol (H2962 manufactured by Hatco: having a branched methyl group and having a branched carbon atom ratio in the ester of 8.9%).

Example 8

A diester (d8) was obtained by mixing 72.5 wt % of the diester (d4) synthesized in Example 4 with 27.5 wt % of H2962.

Comparative Example 1

A diester (d9) was obtained by esterification using 1,8-octanediol and 2-ethylhexanoic acid as raw materials in the same manner as in Example 1.

Comparative Example 2

A diester (d10) was obtained by esterification using 2,4-diethyl-1,5-pentanediol and caprylic acid as raw materials in the same manner as in Example 1.

Table 1 shows compositions and various physical properties of the diesters (d1) to (d10) obtained in Examples and Comparative Examples.

TABLE 1

| | (1) + (2) + (3) % | Branched carbon atom ratio % | Kinetic viscosity $mm^2/s$ | Pour point ° C. | Acid number mgKOH/g | Evaporation loss % |
|---|---|---|---|---|---|---|
| Example 1 | 99.3 | 8.3 | 66.4 | −32.5 | 0.02 | 2.50 |
| 2 | 99.0 | 9.0 | 70.3 | −37.5 | 0.02 | 2.20 |
| 3 | 99.3 | 9.6 | 80.5 | −42.5 | 0.02 | 2.12 |
| 4 | 99.3 | 9.8 | 82.9 | <−45 | 0.01 | 1.89 |
| 5 | 99.3 | 10.0 | 84.8 | <−45 | 0.02 | 1.65 |
| 6 | 99.3 | 10.4 | 87.1 | <−45 | 0.03 | 1.50 |
| 7 | 89.4 | 9.7 | 81.2 | <−45 | 0.02 | 2.29 |
| 8 | 72.0 | 9.6 | 76.8 | <−45 | 0.02 | 2.50 |
| Comp. Example 1 | — | 16.7 | 93.8 | <−45 | 0.03 | 4.20 |
| 2 | — | 16.0 | 95.3 | <−45 | 0.03 | 2.89 |

In Table 1, the term "kinetic viscosity" refers to a value determined at −10° C. The term "evaporation loss" refers to a weight loss (%) determined after a diester has been kept at 120° C. for 8 hours in a thermobalance in a nitrogen atmosphere.

Additive and abbreviation thereof

L57: alkyldiphenylamine (IRGANOX L57 manufactured by BASF, antioxidant)

IR39: benzotriazole derivative (IRGAMET 39 manufactured by BASF, metal deactivator)

OAS1200: succinimide (OAS1200 manufactured by Chevron Chemical Company, ash-free dispersant)

Examples 11 to 14

Lubricating oil compositions were prepared by using as base oils the diesters (d1), (d4), (d7), and (d8) obtained in Examples 1, 4, 7, and 8, respectively, and blending the diesters with 0.5 wt % of 157, 0.03 wt % of IR39, and 1.5 wt % of OAS1200.

Comparative Example 3

A lubricating oil composition was prepared by using the diester (d9) obtained in Comparative Example 1 as a base oil, and blending the diester with 0.5 wt % of 157, 0.03 wt % of IR39, and 1.5 wt % of OAS1200.

Each of the above-mentioned lubricating oil compositions were subjected to an evaporation test and evaluated on its rotating viscosity at −10° C. to simulate bearing torque when used in an oil-impregnated bearing.

The evaporation test was carried out under conditions of 100° C. and 6,000 hours. It should be noted that the evaporation test was carried out using LABORAN screw tubes #3 (volume: 9 ml) including 2 g of samples. The number n of the samples was defined as 2, and the average was determined as an evaporation loss. An evaporation loss of 0.5% or less, determined under conditions of 100° C. and 6,000 hours, was defined as a standard value. According to findings, a lubricating oil having an evaporation loss of 0.5% or more tends to have an exponentially increased evaporation loss after a lapse of 6,000 hours.

The rotation property which causes a problem when the lubricating oil composition is used in an oil-impregnated bearing is low-temperature torque. In particular, when the rotating torque at −10° C. is large, the burden on a buttery increases. Therefore, the bearing torque in an actual machine was simulated by measuring the rotating viscosity at −10° C. It should be noted that a motor manufacturer requires use of a sample having a rotating viscosity at −10° C. of 100 mPa·s or less. Therefore, the standard value was defined as 100 mPa·s or less.

As a measurement device, SVM-3000 manufactured by Anton Paar was used.

TABLE 2

| Example | Base oil | Kinetic viscosity $mm^2/s$ | Pour point ° C. | Acid number mgKOH/g | Evaporation loss % |
|---|---|---|---|---|---|
| 11 | d1 | 70.07 | −32.5 | 0.05 | 0.45 |
| 12 | d4 | 87.29 | −42.5 | 0.05 | 0.40 |
| 13 | d7 | 87.26 | −42.5 | 0.03 | 0.45 |
| 14 | d8 | 78.20 | <−45.0 | 0.03 | 0.49 |
| Comp. Example 3 | d9 | 102.9 | <−45.0 | 0.05 | 0.80 |

Table 2 shows the results of tests for evaluating the lubricating oil compositions in almost real conditions. The kinetic viscosity was measured at −10° C. In all examples, evaporation loss levels were as low as 0.5% or less which satisfied the standard value. In addition, the rotation property was also found to be lower than the standard value, and lubricating oil compositions having low torque at low temperature and exhibiting low evaporation at high temperature, which had a trade-off relationship and were difficult to achieve simultaneously, were obtained.

According to comparison of the compositions, the composition of Example 12 was found to have a lowest evaporation loss and a rotating viscosity lower than the standard value, while the compositions of Examples 13 and 14 prepared by adding a polyol ester were found to be excellent almost without inhibiting their evaporation losses.

It should be noted that the composition of Comparative Example 3 was considered to have a best balance among existing base oils and has been adopted in many small motors. In the present invention, development of a lubricating oil which has performance higher than that of the composition of Comparative Example 3, called "best oil," is considered to contribute to an improvement in performance of a small motor (extension of life-time and saving of energy).

Industrial Applicability

The lubricating oil base oil according to the present invention can provide a lubricating oil composition having characteristics of low volatility and excellent low-temperature fluidity and capable of providing long-lasting lubrication property in a wide temperature range from low temperature to high temperature. In particular, when the oil is applied to a bearing for a small spindle motor related to information equipment, it is possible to achieve low torque (in particular, low-temperature driving property) without impairing durability.

The invention claimed is:

1. A lubricatiu oil base oil, consisting essentially of diesters represented by the following formulae (1), (2), and (3), wherein these three type diesters have same C12 linear alkyl main chain with different branched alkyl both end groups, and wherein a total number of branched carbon atoms involved in methyl groups and ethyl groups present as branched structures in the diesters represented by the formulae (1), (2), and (3) (hereinafter, referred to as "branched carbon atom ratio") is 11% or less with respect to a number of all carbon atoms as the whole diesters, and a molar ratio of the diesters represented by the formulae (1), (2), and (3) falls within a range of (1):(2):(3)=45 to 85:10 to 45:1 to 15:

(1)

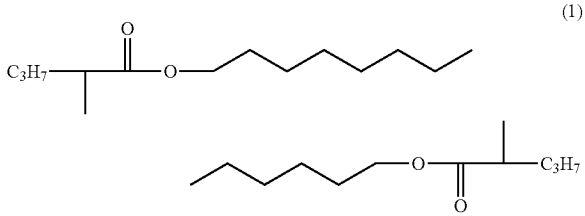

(2)

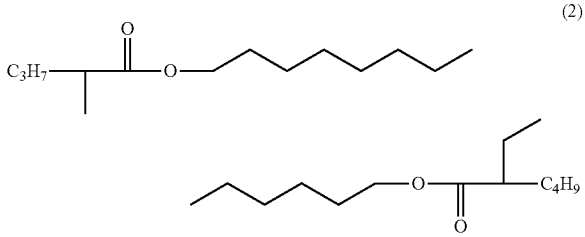

(3)

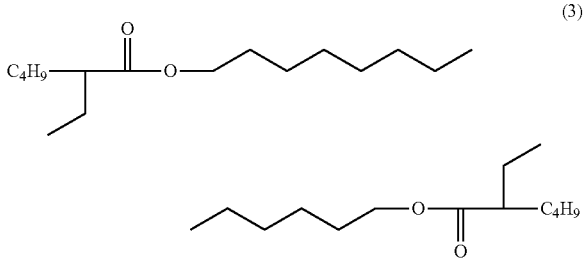

where $C_3H_7$ and $C_4H_9$ represent n-$C_3H_7$ and n-$C_4H_9$, respectively.

2. A lubricating oil base oil according to claim 1, wherein the branched carbon atom ratio of the formula (1) diester is 2/24, that of the formula (2) diester is 3/28, and that of the formula (3) diester is 4/28.

3. A lubricating oil base oil according to claim 1, wherein. the lubricating oil base oil comprises, at a concentration of 30 wt % or less, a low-viscosity oil which comprises a polyol ester having, a kinetic viscosity at 40° C. of less than 9 $mm^2/s$, having a viscosity index of 100 or more, and having a neopentyl glycol skeleton.

4. A lubricating oil base oil according to claim 3, wherein the low-viscosity oil comprises a polyol ester obtained from caprylic acid or capric acid and neopentyl glycol.

5. A lubricating oil composition, which is obtained using the lubricating oil base oil according to claim 1.

6. A lubricating oil composition, which is obtained using the lubricating oil base oil according to claim 2.

7. A lubricating oil composition, which is obtained using the lubricating oil base oil according to claim 3.

8. A lubricating oil composition, which is obtained using the lubricating oil base oil according to claim 4.

* * * * *